United States Patent [19]

Johnson

[11] 4,206,742

[45] Jun. 10, 1980

[54] HEAT EXTRACTOR AND SHIELD FOR ROOM STOVES AND THE LIKE

[76] Inventor: Albert V. Johnson, R.R. 1, Box 87, Erhard, Minn. 56534

[21] Appl. No.: 906,831

[22] Filed: May 17, 1978

[51] Int. Cl.[2] ..... F24B 3/00; F28F 13/00; E04F 17/04

[52] U.S. Cl. ..... 126/66; 98/48; 126/67; 165/95; 165/135; 165/DIG. 2; 236/16; 237/55

[58] Field of Search ..... 165/DIG. 2, 95, 135; 237/55; 98/48; 236/16; 126/110 R, 116 R, 66, 67

[56] References Cited

U.S. PATENT DOCUMENTS

| | | | |
|---|---|---|---|
| 43,992 | 8/1864 | Holmes | 165/96 |
| 53,029 | 3/1866 | Morse | 165/128 |
| 349,534 | 9/1886 | Smith | 165/158 |
| 417,874 | 12/1889 | Leonard | 165/DIG. 2 |
| 705,507 | 7/1902 | Williamson | 165/96 |
| 762,203 | 6/1904 | Segerstrom | 165/128 |
| 1,715,941 | 6/1929 | Morgan | 165/135 |
| 1,986,878 | 1/1935 | Cornelius | 165/135 |
| 2,067,560 | 1/1937 | Bollheimer | 165/95 |
| 2,343,542 | 3/1944 | Faunce | 165/DIG. 2 |
| 2,362,940 | 11/1944 | Skerritt | 165/DIG. 2 |
| 2,764,391 | 9/1956 | Pullen | 165/122 |
| 2,882,023 | 4/1959 | Rizzo | 165/DIG. 2 |
| 2,902,265 | 9/1959 | Dubovick | 165/DIG. 2 |
| 3,106,241 | 10/1963 | Reustle | 165/DIG. 2 |
| 3,934,798 | 1/1976 | Goldsmith | 165/DIG. 2 |
| 4,050,627 | 9/1977 | Mayer | 165/DIG. 2 |
| 4,050,628 | 9/1977 | Konnerth | 165/DIG. 2 |
| 4,103,735 | 8/1978 | Warner | 237/55 |
| 4,105,042 | 8/1978 | Johnston | 165/95 |
| 4,106,474 | 8/1978 | Hunter et al. | 165/DIG. 2 |
| 4,121,656 | 10/1978 | Huber | 165/95 |

*Primary Examiner*—James C. Yeung
*Assistant Examiner*—Daniel J. O'Connor
*Attorney, Agent, or Firm*—Merchant, Gould, Smith, Edell, Welter & Schmidt

[57] ABSTRACT

An apparatus for extracting heat from the waste gases of a stove to heat the air in the room. The apparatus is mounted on the stove and includes a central chamber in which an inner core, having a plurality of passageways, is positioned. Waste gases from the stove enter the central chamber, pass through the passageways of the inner core so as to heat the air surrounding the inner core, and then exit from the central chamber. A removably mounted closure is mounted on the top end of the central chamber to enable cleaning of the insides of the passageways. A heat shield which extends below the bottom end of the central chamber so as to surround the back and sides of the stove is provided to protect adjacent walls from the heat radiated by the stove.

3 Claims, 6 Drawing Figures

HEAT EXTRACTOR AND SHIELD FOR ROOM STOVES AND THE LIKE

FIELD OF THE INVENTION

This application relates to heat extractors for room stoves and the like. In particular, this application relates to a heat extractor which can be easily cleaned while remaining in place and which insures that heat generated by the stove efficiently and effectively heats the room.

BACKGROUND OF THE INVENTION

It is known in the art to pass heated gases and smoke through a plurality of fixed cylindrical tubes to heat the air surrounding the tubes. The insides of the cylindrical tubes often become coated with soot, creosote and the like. Therefore, the insides of the tubes must be periodically cleaned in order that the tubes can maintain a high degree of efficiency in conducting heat.

Another problem encountered, especially with Franklin stoves, is heat radiated by the back and sides of the stoves. Frequently, the heat radiated by the back and sides of the stove can damage the adjacent walls and surrounding environment which is near the stove.

PRIOR ART

The patents to Leonard, U.S. Pat. No. 417,874, issued Dec. 24, 1899; and Smith, U.S. Pat. No. 349,534, issued Sept. 21, 1886, disclose devices which may be disassembled for the purpose of cleaning the cylindrical tubes of the heat extractor by using a long brush to scrub the insides of the tubes. Leonard discloses a tubular heating drum having a plurality of tubes connected to an upper head and a lower head. The lower head includes an annular plate and an upper plate. The upper plate is connected to the annular plate by bolts so that by removing the bolts, the annular upper plate can be detached for readily cleaning the drum.

Smith discloses a heating attachment for stovepipes having upper and lower conical chambers provided with perforations into which fit the ends of a plurality of tubes. The bases of the chambers are connected by means of a rod which serves to draw the base of the chambers toward each other and to draw the perforations firmly upon the ends of tubes.

The Leonard and Smith devices have a number of disadvantages. First, in the case of the Smith device, the heat extractor must be almost totally disassembled in order to clean the tubes and is thus inconvenient for that reason. Second, in the case of the Leonard device, removal of the annular plate in order to clean the tubes necessitates that the Leonard device be disconnected from the pipes to which it is connected which is also undesirable.

SUMMARY OF THE INVENTION

Applicant has invented a new and useful apparatus for extracting heat from the waste gases of a stove in order to heat the air of the room in which the stove is located. The heat extractor includes a central chamber having a lower partially closed heat exchange portion provided with an inlet and an outlet for air to be heated, a lower waste gas inlet portion, and an upper waste gas discharge portion from which the waste gases exit from the central chamber. The heat extractor includes an inner core position within the heat exchange portion which is provided with passageways through which the waste gases pass so as to heat the air surrounding the inner core. The central chamber and inner core are mounted on the stove so that waste gases from the stove pass only through the passageways.

To enable cleaning access to the passageways of the inner core, a closure removably mounted on the top end of the central chamber is provided. The removable closure can be removed so that the inside of the passageways can be cleaned without the heat extractor having to be disassembled or dismounted from the stove. A heat shield is also provided which extends below the bottom end of the central chamber and surrounds the back and sides of the stove. The heat shield insures that walls or other environmental structures near the stove are not damaged by the heat radiated by the back and sides of the stove. Thus, Applicant's apparatus is easily cleanable without substantial disassembly or removal, while at the same time insuring that heat radiated from the stove does not damage surrounding environmental structures.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further port hereof, and to the accompanying descriptive matter, in which there are illustrated and described certain preferred embodiments of the invention.

DETAILED DESCRIPTION OF THE PREFERRED EMBODIMENT

Figures 1, 6:
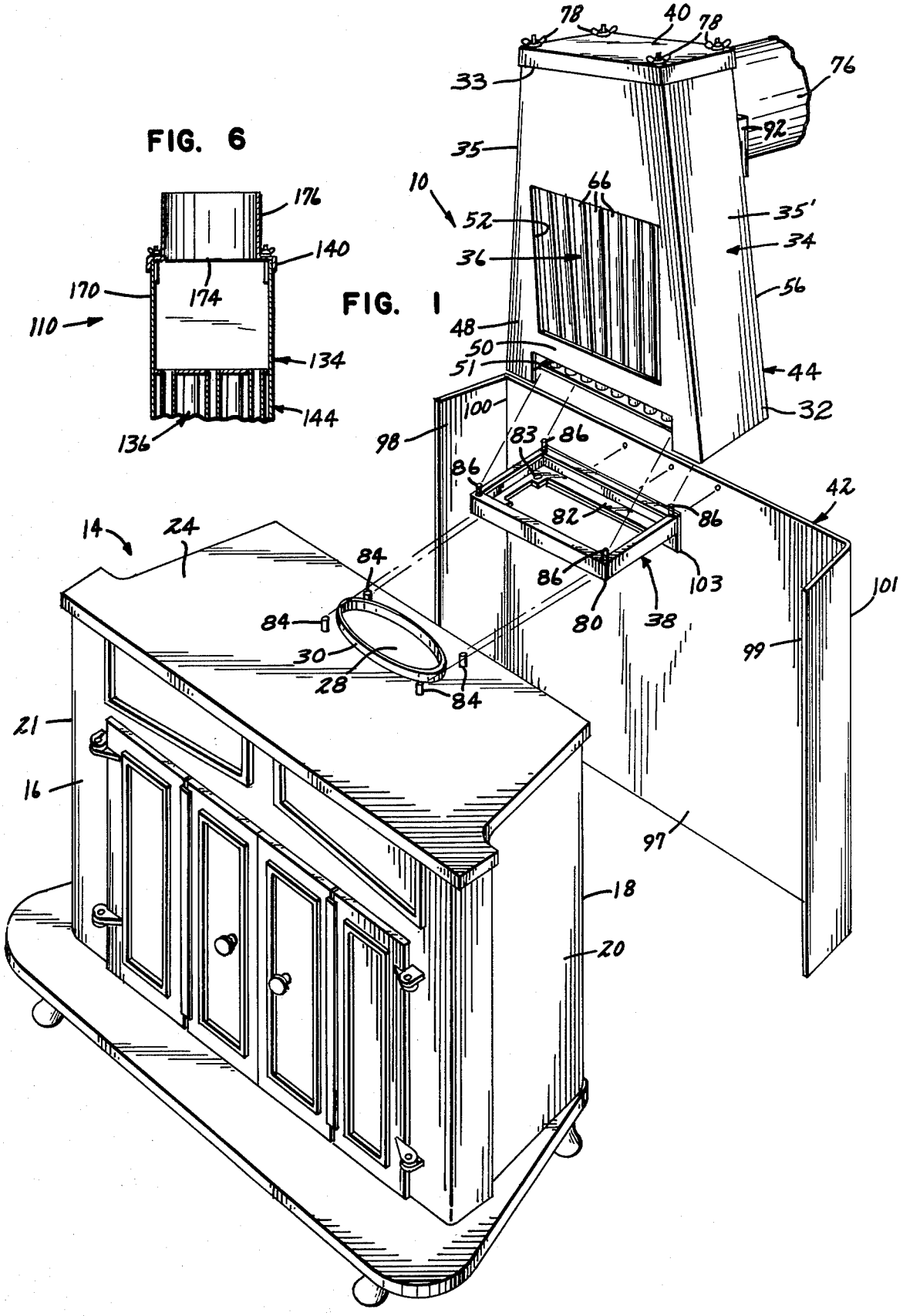
FIG. 1 is an exploded view of a heat extractor according to the present invention which is mountable on top of the stove.
FIG. 6 is a fragmentary view to a smaller scale of a second embodiment of a heat extractor according to the present invention.

Referring now to the drawings, FIG. 1 shows a heat extractor according to the present invention generally designated by the numeral 10. Heat extractor 10 is utilized in connection with a stove, such as a Franklin stove, indicated by numeral 14. Stove 14 has a front 16, a back 18, opposite sides 20, 21, and a top 24. A waste gas exit port 28 is formed in the top 24 and has a generally elliptical lip 30 surrounding it and extending upwardly from the top 24.

Heat extractor 10 generally includes a central chamber 34, having a bottom end 32, a top end 33 upwardly and inwardly sloping sides 35 and 35', an inner heat exchanger core 36, and an inlet plenum 38 for mounting chamber 34 and core 36 on the stove 14. A removable closure 40 is mounted on the top end of chamber 34 while a heat shield 42 extends below the bottom end of chamber 34. Chamber 34 includes a lower heat exchange portion in the form of an apertured housing indicated by numeral 44. Front 48 of housing 44 has a cross brace 50 which divides the front of housing 44 into a small aperture 51 provided at the bottom end of the housing and a larger hot air outlet aperture 52 above cross brace 50. Back 56 of housing 44 is provided with a pair of access apertures 58 and 59 at the bottom end thereof.

Figures 2, 3, 4, 5:
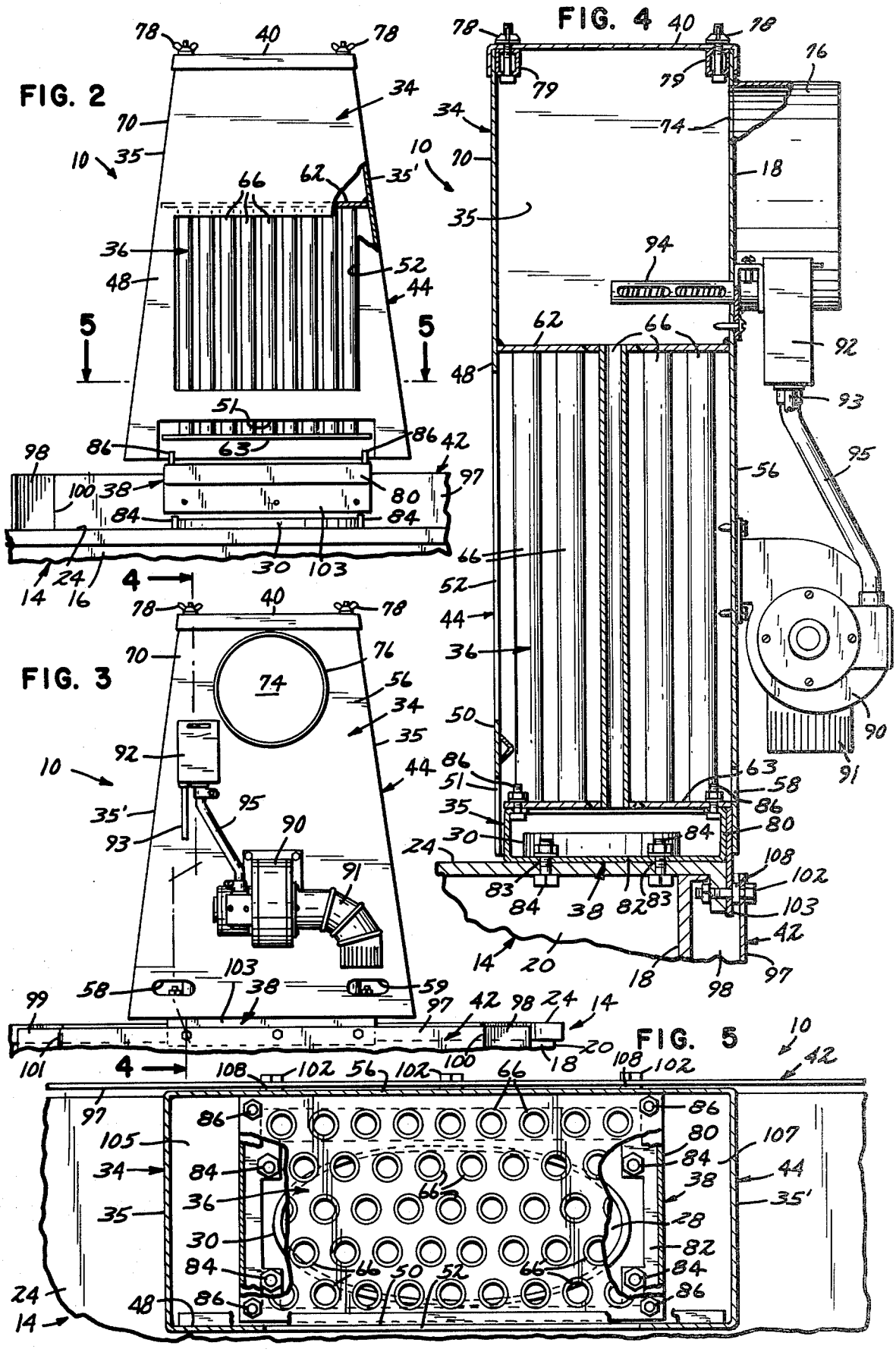
FIG. 2 is a front elevational fragmentary view with parts broken away of a heat extractor according to FIG. 1.
FIG. 3 is a fragmentary rear elevational view of a heat extractor according to FIG. 2.
FIG. 4 is an enlarged sectional view taken generally along irregular line 4—4 of FIG. 3.
FIG. 5 is an enlarged sectional view taken generally along line 5—5 of FIG. 2.

Referring in particular to FIG. 4, core 36 includes a top header 62 and a bottom header 63. A plurality of holes are formed in both header 62 and 63 for receiving the upper and lower ends of a plurality of hollow elements in the form of laterally spaced generally parallel cylindrical tubes 66, which comprise a passageway between headers 62 and 63. Core 36 is positioned within the housing 44 of chamber 34 so that chamber 34 is supported by core 36.

Chamber 34 further includes an upper waste gas discharge portion in the form of outlet plenum 70. Header 62 is secured by suitable means, such as welding, to the inside of chamber 34 so that header 62 divides and separates the waste gas discharge portion from the heat exchange portion of chamber 34. Outlet plenum 70 is further provided with a waste gas discharge port 74 from which extends a generally horizontal waste gas discharge conduit. 76. Closure 40 is releasably secured to the top end of outlet plenum 70 by suitable fasteners 78 which are secured to suitable retention members 79 attached to the top end of outlet plenum 70.

Referring to FIGS. 1, 4 and 5, inlet plenum 38 includes a generally rectangular main frame 80. The inlet plenum further includes a bottom retention plate 82 secured to the bottom end of main frame 80. Plate 82 is provided with spaced holes 83 which are inserted over suitable means in the form of bolts 84 mounted on top 24 of the stove and is secured to top 24 by suitable fasteners. The top end of main frame 80 is releasably secured to header 63 by means of suitable fasteners 86 which are inserted into aligned holes provided in both header 63 and main frame 80. Apertures 52, 58 and 59 provide access to fasteners 86 so that header 63 can be readily disconnected from or reconnected to frame 80.

Referring, in particular, to FIGS. 3 and 4, a motor driven air mover or blower 90 having an air inlet member 91 is mounted on the heat exchange portion of central chamber 34 for circulating air into chamber 34 through an inlet in back 56 not shown. A temperature sensing device 92 is mounted on outlet plenum 70 so that temperature sensing probe 94 extends into the inside of the outlet plenum. Blower 90 is energized from a suitable source 93 of electrical energy under the control of device 92 through a cable 95.

Referring, in particular, to FIG. 1, heat shield 42 extends generally sidewardly and downwardly from central chamber 34. Heat shield 42 is provided with a main portion in the form of panel 97, wider than back 56, and side portions in the form of panels 98 and 99 which extend outwardly from horizontally spaced side edges 100 and 101 of panel 97. Panel 97 is mounted on flange 103 fixed to the back end of frame 80. Panel 97 is secured to flange 103 by suitable fasteners 102. As shown particularly in FIG. 4, shield 42, as well as flange 103, is attached to top 24 of the stove for additional support. Spacers 108 inserted on fasteners 102 space shield 42 slightly away from flange 103. Side panels 98 and 99 preferably extend at generally obtuse angles from panel 97 so as to be suitably configured to the back and sides of stove 14. Heat shield 42 prevents excessive warming of the adjacent wall or walls near which the stove is positioned.

As shown particularly in FIG. 5, header 63 and main frame 80 are spaced away from sides 35 and 35' of chamber 34 so as to define air inlets 105 and 107. The bottom end of chamber 34 is spaced sufficiently away from the top 24 of the stove so that fresh air enters heat exchange portion 44 through opening 51 and inlets 105 and 107.

An alternative embodiment 110 of the present invention is shown in FIG. 6. When necessary to discharge the waste gases vertically out from outlet plenum 170, discharge port 174 is formed in removable closure 140. A discharge conduit 176 is connected to removable closure 140 and extends upwardly therefrom to conduct the waste gases out through an outlet pipe not shown.

In operation, stove 14 is stoked with suitable fuel, such as wood, and a fire is started. The waste gases from the stove exit through port 28 and into inlet plenum 38 which is secured to top 24 of the stove 14 so that the waste gases will only pass from port 28 through the inlet plenum 38. Inlet plenum 38 is secured to bottom header 63 so that the waste gases can only pass through tubes 66. The waste gases then pass through tubes 66 upwardly into outlet plenum 70 and then through discharge port 74 and discharge conduit 76 to a suitable outlet pipe not shown. Header 62 is welded to chamber 34 so that the waste gases will not pass from waste gas discharge portion 70 to the heat exchanger portion 44 of chamber 34.

As waste gases pass through the tubes, the air surrounding them becomes heated. Blower 90 draws in fresh air through member 91, circulates the air about the tubes and then forces it outwardly through aperture 52, thereby heating the room. Sensing device 92 controls the operation of blower 90 by sensing the temperature in outlet plenum 70, e.g., turns the blower on when waste gases are entering the outlet plenum, turns the blower off when waste gases are no longer entering the outlet plenum, or varies the operation of the blower in response to changes in the temperature of the outlet plenum.

Numerous characteristics and advantages of the invention have been set forth in the foregoing description, together with details of the structure and function of the invention, and the novel features thereof are pointed out in the appended claims. The disclosure, however, is illustrative only, and changes may be made in detail especially in matters of shape, size, and arrangement of parts, within the principle of the invention, to the full extent indicated by the broad general meaning of the terms in which the appended claims are expressed.

What is claimed:

1. Apparatus for recovering heat from the waste gases of a stove having a back, a pair of sides and a top including a waste gas exit port while shielding structures near the stove from heat radiating from the back and sides of the stove, comprising:

a central chamber having a bottom end and a top end and including a lower partially closed heat exchange portion, having an inlet and an outlet for air to be heated, a waste gas entrance portion or inlet plenum at said bottom end of said central chamber, and an upper waste gas discharge portion, at said top end, having a waste gas discharge port from which the waste gases exit from said central chamber;

an inner core positioned within said lower portion, said core comprising top and bottom headers, and connecting means providing a passageway between said top and bottom headers through which the waste gases pass from said inlet plenum to said upper portion so as to heat the air surrounding said passageway, said top header being connected to said central chamber so as to prevent the waste gases from passing from said upper portion to said lower portion;

means for mounting said central chamber and said inner core on the top of said stove so that said inlet plenum receives the waste gases from the waste gas exit port and so that the waste gases pass from said inlet plenum to said upper portion only through said passageway;

and a heat shield extending from and below said bottom end of said central chamber and spaced from the back and sides of the stove.

2. An apparatus according to claim 1 further comprising means for circulating a flow of air through said air inlet into and out of said lower portion, wherein said circulation means comprises a motor-driven air mover mounted on said lower portion near said air inlet and which further comprises means responsive to the temperature of said waste gases in said upper portion for controlling the operation of said air mover.

3. Apparatus for recovering heat from the waste gases from a stove having a back, a pair of sides, and a top with a waste gas exit port and for protecting structures near the stove from heat radiating from the back and sides of the stove, comprising:

a heat exchanger core including a plurality of generally vertical spaced hollow elements extending between and sealed into upper and lower headers;

means for mounting said core over said exit port with said lower header spaced vertically thereabove, and for directing the waste gases to pass only through said elements;

an apertured housing supported by said core and tapering upwardly thereabout, said housing being larger at its bottom end than the waste gas exit port and being spaced vertically above the top of the stove to provide inlets for ambient air at the bottom of said housing;

a closed outlet plenum connected to said upper header for conducting away gases rising through said core, said plenum including a removable closure to give cleaning access to the inside of said elements, and a waste gas discharge port from which the waste gases and smoke exit from said plenum; and a heat shield extending downwardly and sidewardly below said core and said housing for encompassing the sides and the back of the stove.

* * * * *